United States Patent [19]

Bulso, Jr. et al.

[11] Patent Number: 4,808,052

[45] Date of Patent: Feb. 28, 1989

[54] METHOD AND APPARATUS FOR FORMING CONTAINER END PANELS

[75] Inventors: Joseph D. Bulso, Jr., Canton; James A. McClung, North Canton, both of Ohio

[73] Assignee: Redicon Corporation, Canton, Ohio

[21] Appl. No.: 163,863

[22] Filed: Mar. 3, 1988

Related U.S. Application Data

[63] Continuation-in-part of Ser. No. 889,683, Jul. 28, 1986, abandoned.

[51] Int. Cl.[4] ..... B21D 51/44

[52] U.S. Cl. ..... 413/8; 413/56; 413/62; 72/348

[58] Field of Search ..... 413/8, 56, 62; 72/347, 72/348, 350, 351

[56] References Cited

U.S. PATENT DOCUMENTS

| | | | |
|---|---|---|---|
| 3,537,291 | 11/1970 | Hawkins | 72/336 |
| 4,031,837 | 6/1977 | Jordan . | |
| 4,054,228 | 10/1977 | Balocca et al. | 220/268 |
| 4,093,102 | 6/1978 | Kraska | 220/67 |
| 4,109,599 | 8/1978 | Schultz . | |
| 4,516,420 | 5/1985 | Bulso, Jr. et al. | 72/329 |
| 4,549,424 | 10/1985 | Bulso, Jr. et al. | 72/329 |
| 4,571,978 | 2/1986 | Taube et al. | 72/349 |

*Primary Examiner*—Frederick R. Schmidt
*Assistant Examiner*—Robert Showalter
*Attorney, Agent, or Firm*—Reese Taylor

[57] ABSTRACT

A method of forming a container end piece from a sheet of material includes the steps of forming an inverted cup by wiping a peripheral edge of the material over a die core ring, inverting the cup by advancing a punch core into the material, thereby forming a flanged area, a central bottom area and a chuckwall interconnected thereto by a radiused portion. The radiused portion is initially formed by an annular nose on the punch core larger than the final radius. The punch core is then retracted and exerts force on the flanged area to shorten the chuckwall and reduce the radius by forcing the material in the chuckwall and radiused areas into the space between a die core and die core ring. A modified method includes supporting and aligning the radiused area with a contoured knockout sleeve between the die core and die core ring. The apparatus includes a punch core having a radiused annular nose which can be advanced into the inverted cup to form a reversed cup having a flanged area, a chuckwall and a central bottom area with the chuckwall interconnected to the central bottom area by a radiused portion conforming to the radius on the punch core. The apparatus further includes a die core and a die core ring which are concentric and spaced apart and also includes a pressure sleeve acting on the flanged area to force material from the chuckwall and the radiused area into the space between the die core and die core ring, thereby shortening the chuckwall and tightening the radius.

8 Claims, 6 Drawing Sheets

METHOD AND APPARATUS FOR FORMING CONTAINER END PANELS

RELATED PATENT APPLICATIONS

This application is a continuation-in-part of applicants' earlier filed application Ser. No. 889,683,filed July 28, 1986, now abandoned.

FIELD OF THE INVENTION

This invention relates, in general, to forming end panels or closures for two piece or three piece containers from a blank of metal and relates, in particular, to a method and apparatus for forming such end panels in double acting presses with the resulting product having an improved strengthened chuckwall area formed without unacceptable thinning of the metal during forming.

DESCRIPTION OF THE PRIOR ART

End panels for two piece or, for that matter, three piece metal containers are well known in the art. Examples of various end panels of this general type and of methods for forming them can be seen in Hawkins U.S. Pat. No. 3,537,291; Jordan U.S. Pat. No. 4,031,837; Balocca U.S. Pat. No. 4,054,228; Kraska U.S. Pat. No. 4,093,102; Schultz U.S. Pat. No. 4,109,599; Bulso U.S. Pat. No. 4,516,420; Bulso U.S. Pat. No. 4,549,242; and Taube U.S. Pat. No. 4,571,978.

Particularly in the beer and beverage industries where the contents are packaged under pressure, certain contours, commonly known as the chuckwall and countersink radius, are formed in these end panels to impart the strength necessary for them to withstand these internal pressures. It is of major importance in forming these end panels to control the thickness of the metal during the forming operation while providing adequate strength in the critical chuckwall area of the panel while also insuring that the countersink and chuckwall are maintained in a concentric condition with respect to the midpoint of the end panel.

In this industry, there is also constant stress on reducing starting metal thickness. Reduction of one thousandth of an inch in the gauge of the starting metal can produce phenomenal savings over the course of a production year in view of the tremendous quantities of these pieces produced.

Nevertheless, while it is, of course, desirable to achieve this metal reduction for economic reasons, certain problems are commonly encountered when this is attempted.

Specifically, as noted, these end panels are contoured and have what is usually called a chuckwall formed in them. These chuckwalls are essentially annular and include vertical wall surfaces which extend downwardly from adjacent the peripheral edge of the panel and then upwardly to the main body portion of the panel with the walls being joined at the bottom by a countersink radiused area. In essence, it can be said that the tighter the radius, the better the chuckwall and the stronger the end panel. However, with the constant pressure for reduction in starting gauge of the material, the material becomes harder and thinner and more and more difficult to draw in conventional draw and redraw equipment to the required or desired small radius without destruction of the article due to the stress created by drawing the metal about a sharply radiused tool.

The obvious solution to the problem created in the forming of such a tight radius is to start with thicker material so that, when the panel is thinned during forming, sufficient thickness remains in the finished product. Unfortunately, this defeats the object of achieving economy by reducing starting thickness and also results in too much or unnecessary thickness in some other areas where it is not needed.

Attempts to resolve this problem have been made in various ways, primarily by producing the end panel in a forming and reforming operation normally accomplished in successive stations in the press so as to avoid a single drastic draw over a sharp radius. Such a draw, with very thin, hard metal, can result in metal failure.

Therefore, it is felt that if this could be accomplished in a single station with a single hit or draw, considerable savings can be accomplished in the manufacturing operation while providing the desired stability and strength in the chuckwall area and achieving only the desired reduction in the thickness of the starting material.

SUMMARY OF THE INVENTION

It has been found that considerable reduction in material starting gauge without detracting from the strength of the finished product can be achieved by essentially drawing an overlength chuckwall with an oversized radius and then reforming it at the same station without further drawing of the material in the final step.

To that end, it has been discovered that utilization of a punch having an oversized or overradiused blunt end can be employed to initially form the end panel with an oversized radius. It has then been found that the chuckwall, being overlength can be folded back into the material to reduce the radius, shorten the chuckwall and provide material for the center part of the end panel without damage to the material which is a common problem in small radius areas.

It has also been found that improved support can be provided for the radiused area during forming by disposing a knockout sleeve, having a concave upper surface, beneath the punch.

It has further been found that utilization of such a knockout sleeve will also assist in insuring concentricity of the radiused area for improved double seaming of the finished end to the container.

Accordingly, production of an improved method and apparatus for forming and reforming end panels of the character above-described becomes the principal object of this invention with other objects thereof becoming more apparent upon the reading of the following brief specification considered and interpreted in view of the accompanying drawings.

BRIEF DESCRIPTION OF THE PREFERRED EMBODIMENTS

Figure 1:
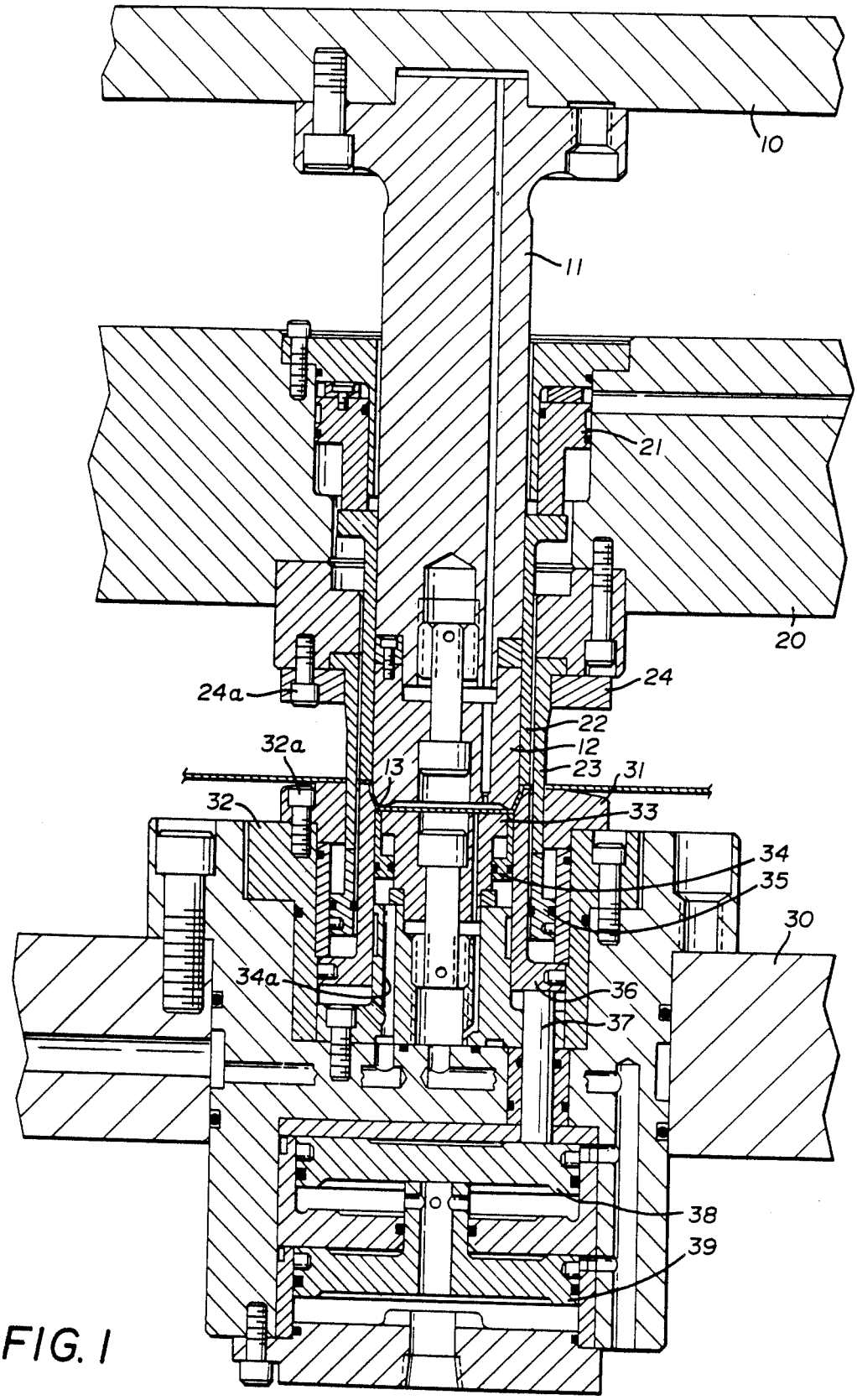
FIG. 1 is an elevational assembly view partially in section showing the apparatus at the end of the first step.
Figure 2:
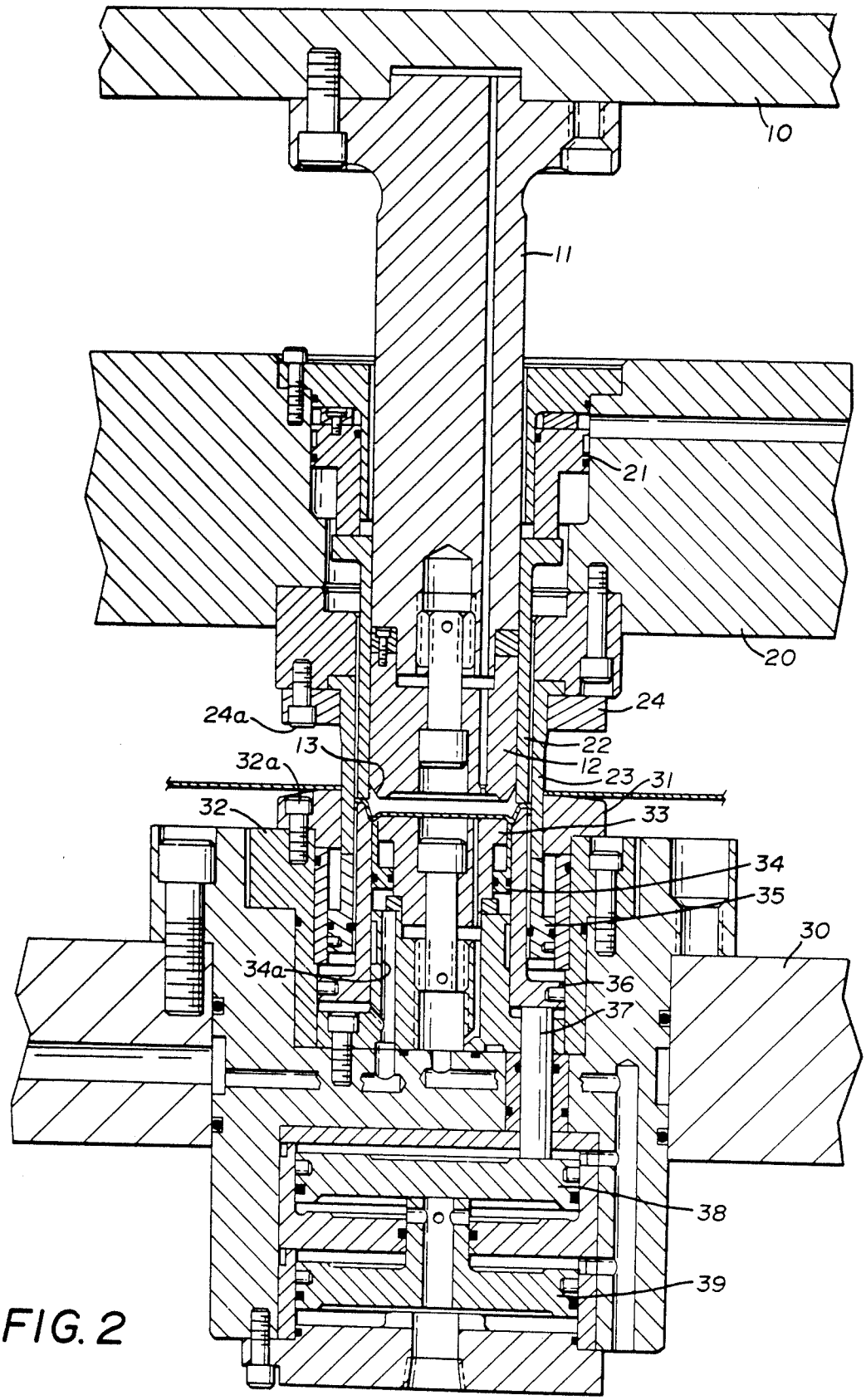
FIG. 2 is a view similar to FIG. 1 showing the apparatus at the final step of the operation.

Referring first to FIGS. 1 and 2 of the drawings, it will be seen that the tooling of the present method and apparatus is intended to be utilized in a double acting press having an inner slide holder 10 and outer slide holder 20 which carry the various tooling components. A fixed base 30 is also employed with the arrangement being that the slides 10 and 20 are reciprocal toward and away from fixed base 30.

Carried on the inner slide holder 10 is a punch center post 11, which has secured to it a punch core 12. This punch core 12 has a bottom surface which is contoured so as to impart the desired preliminary configuration to the end panel, as will be described more fully below.

To that end, it will be noted that the punch core 12 tapers to an annular nose 13 which has a rather large radius relative to the final radius to be formed in the chuckwall area of the end panel. One example would be wherein the radius on the annular nose 13 is on the order of 0.030 inches while the end product has a desired chuckwall radius of 0.020.

Carried by the outer slide holder 20 is an upper fluid actuated piston 21 and an upper pressure sleeve 22 which is disposed beneath and acted on by the piston 21 for holding purposes as will be described.

Also carried by the outer slide holder 20 is a punch shell 23 which is held in place by the punch shell clamp 24 and suitable screws **24*a* and which is disposed in concentric relationship with punch core 12**.

Carried on fixed base 30, which is disposed opposide slide holders 10 and 20, is a cut edge 31 which is held on the cut edge retainer 32 by one or more screws **32*a***.

Also received in the base 30 is a fixed die core pad 33 and a concentric knockout piston 34. This knockout piston 34 is actuated by suitable fluid pressure through the bore **34*a*** and functions to return the finished product to the die line.

Also received in concentric relationship with and outboard of the knockout piston 34 and the die core pad 33 is a lower pressure sleeve 35 actuated again by suitable fluid pressure.

Between the lower pressure sleeve 35 and the knockout sleeve 34 and concentric therewith is a die core ring 36.

The die core ring 36 is supported on one or more posts 37, which are in turn supported on stacked pistons 38 and 39 so that the die core ring 36 is movable within base 30 and toward and away from the inner and outer slide holders 10 and 20.

Figure 3:
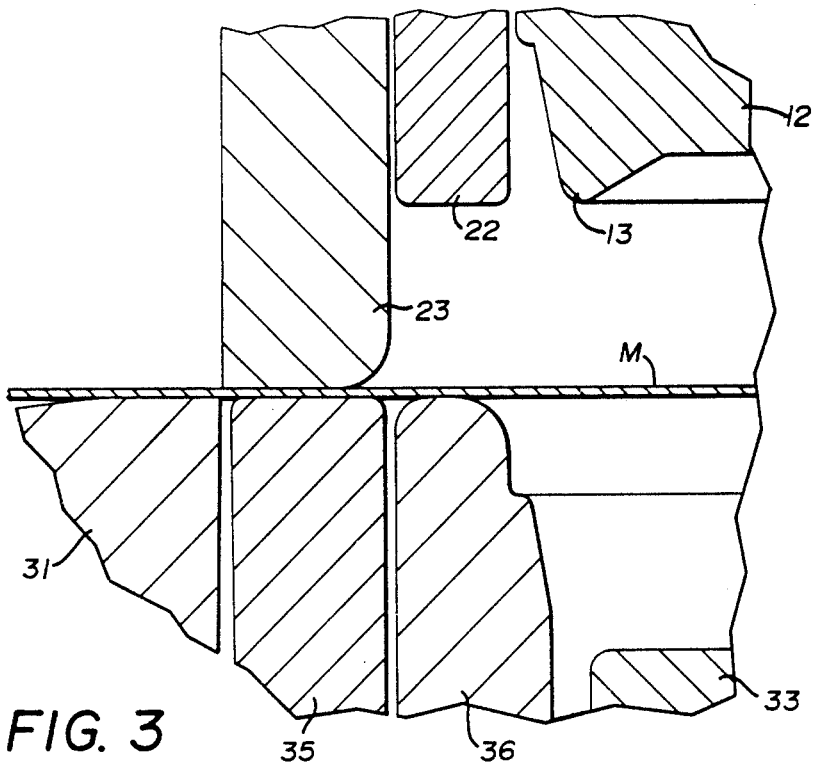
FIG. 3 is an enlarged, partial sectional view showing the position of the relevant components of the tooling prior to blanking.

Turning to FIGS. 3 through 6 for a description of the operation of the improved apparatus, it will be seen that in FIG. 3 the punch shell 23 has been advanced by movement of outer slide holder 20 to trap the material M against the top of the lower pressure sleeve 35. The upper pressure sleeve 22 and the punch 12 are elevated at this point and the top of the die core ring 36 is disposed beneath the bottom surface of the material M.

Figure 4:
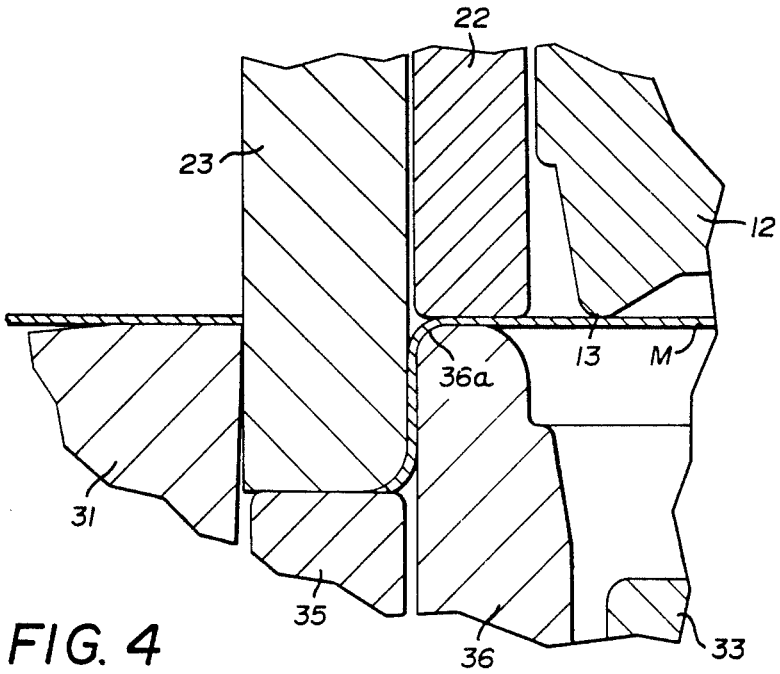
FIG. 4 is an enlarged, partial sectional view showing the relevant components of the tooling following blanking and drawing of a reverse end piece.

Further downward movement of the inner and outer slide holders 10 and 20 will move the tooling components from the position of FIG. 3 to that of FIG. 4. At that time the punch shell 23 will have blanked the material M against the cut edge 31 and will have forced the lower pressure sleeve 35 down by overcoming the fluid pressure which normally supports it. At the same time, the periphery of the blank will have been wiped around the radius **36*a* of the die core ring 36** so as to form the metal into the shape of an inverted cup still designated by the letter M.

Also, at this time, the upper pressure sleeve 22 will have advanced so as to trap an inboard area of the material M against the top of the die core ring 36 and the punch 12 will have just come into contact with the top surface of the material M.

Figure 5:
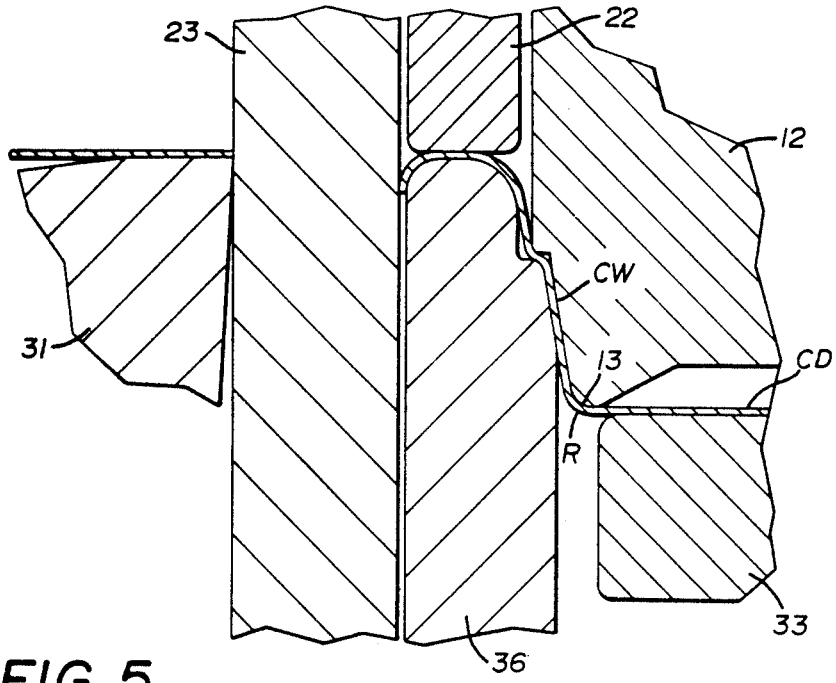
FIG. 5 is an enlarged, partial sectional view of the pertinent components of the tooling showing their position following inverting of the cup and forming of the wide radius.

Further downward movement of the slide holders 10 and 20 will move the tooling from the position of FIG. 4 to the position of FIG. 5. At this time, it will be noted that upper pressure sleeve 22 will continue to clamp the peripheral flange area of the end piece against the top of die core ring 36. However, the further downward movement of the inner slide 10 will force the punch 12 below the die line and at this point the previously formed inverted cup will be re-inverted by pulling the material over the top of die core ring 36 so as to form a chuckwall portion CW and a center bottom portion CD interconnected by a radiused area R. It will be noted that this radiused area R is formed by the annular nose 13 on the punch 12 and, as previously noted, the radius on the annular nose 13 is oversized with regard to the desired final radius.

Figure 6:
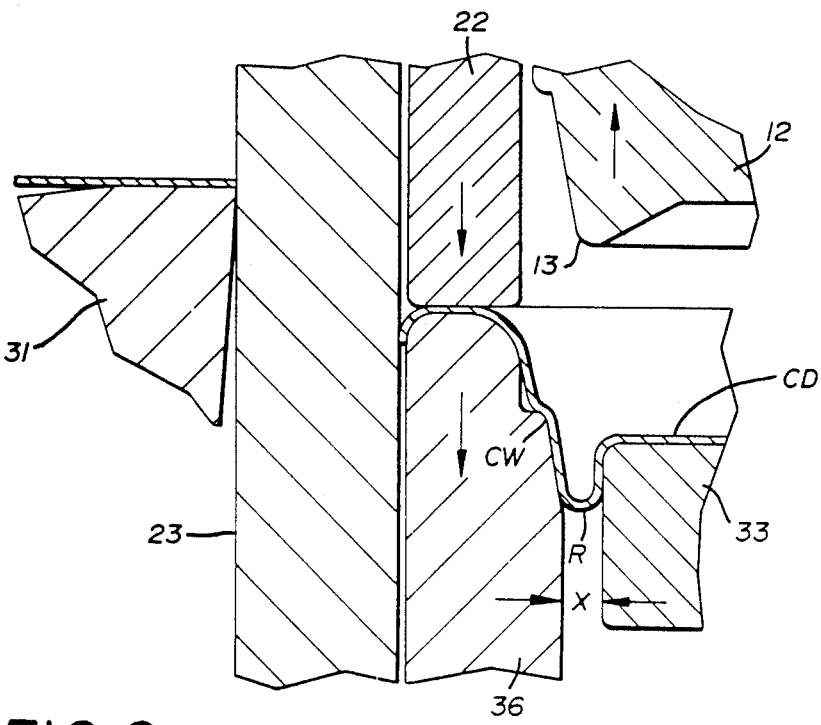
FIG. 6 is an enlarged, partial sectional view showing the relevant components of the tooling following shortening of the chuckwall and tightening of the radius.
Figure 7:
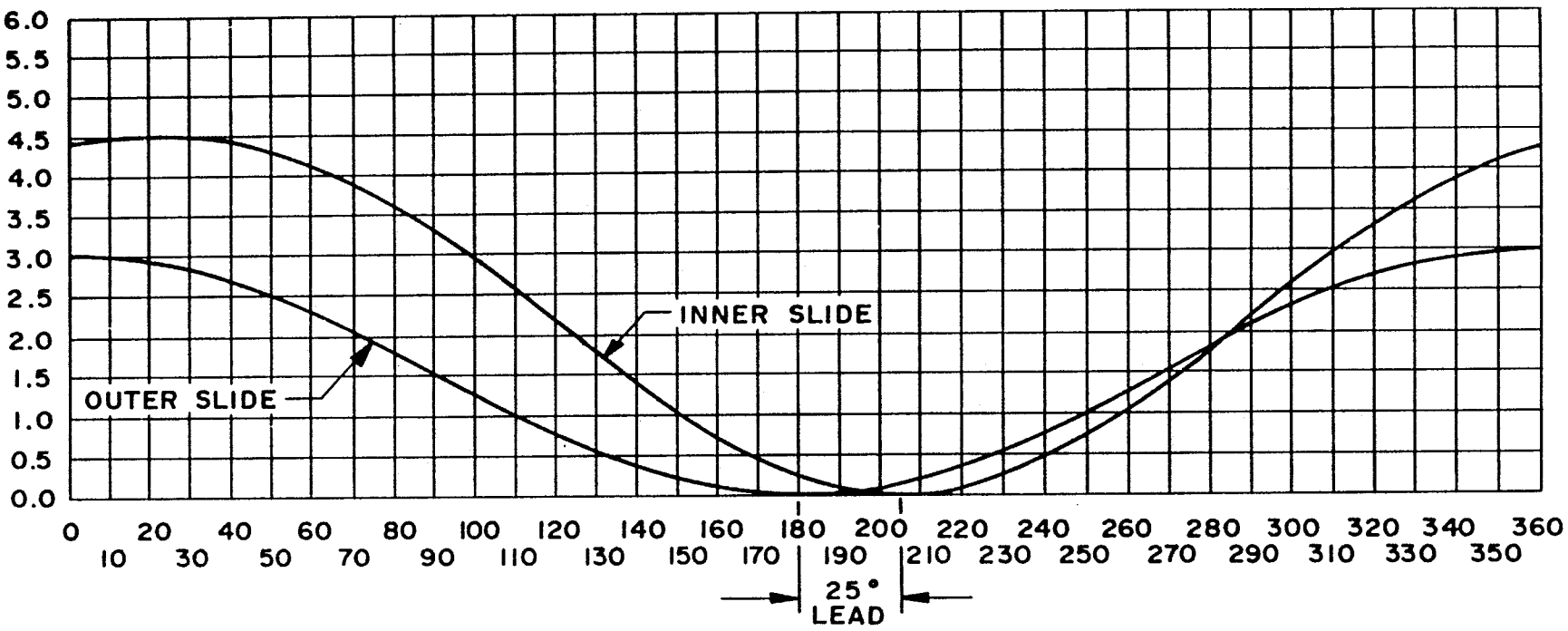
FIG. 7 is a timing diagram.

At this time, further action of the press will move the tooling components from the position of FIG. 5 to the position of FIG. 6. In that regard, it will be noted that the upper pressure sleeve 22 will continue its downward movement having bottomed piston 21 against the fixed structure of the outer slide holder 20 and this continued downward movement will overcome the fluid supporting the die core ring 36 so that it to will move downward as indicated by the arrows in FIG. 6.

At the same time, the punch 12 will have lifted off and be out of engagement with the material M. However, the downward movement of the pressure sleeve 22 and die core ring 36 will push some of the material from the chuckwall area CW down into the space X between the inner periphery of the die core ring 36 and the outer periphery of the die core 3 so as to shorten the length of the chuckwall and tighten the radius R.

Activation of knockout sleeve 34 will then raise the finished product to the die line upon retraction of slides 10 and 20.

As previously noted, in one example, wherein the annular nose 13 forms an initial radius R in the order of 0.030 inches, the movement from the position of the components from FIG. 5 to FIG. 6 will reduce that radius to approximately 0.020 inches which is, in this example, its final desired dimension. This is accomplished by pushing the metal out of the chuckwall area CW down through the radiused area R without actually drawing the material about a sharply radiused tool. In effect, the material is simply guided into the desired area.

The result is a tight radius and a strong chuckwall without unacceptable metal thinning since the metal is never really drawn about a sharp radius.

Figure 8:
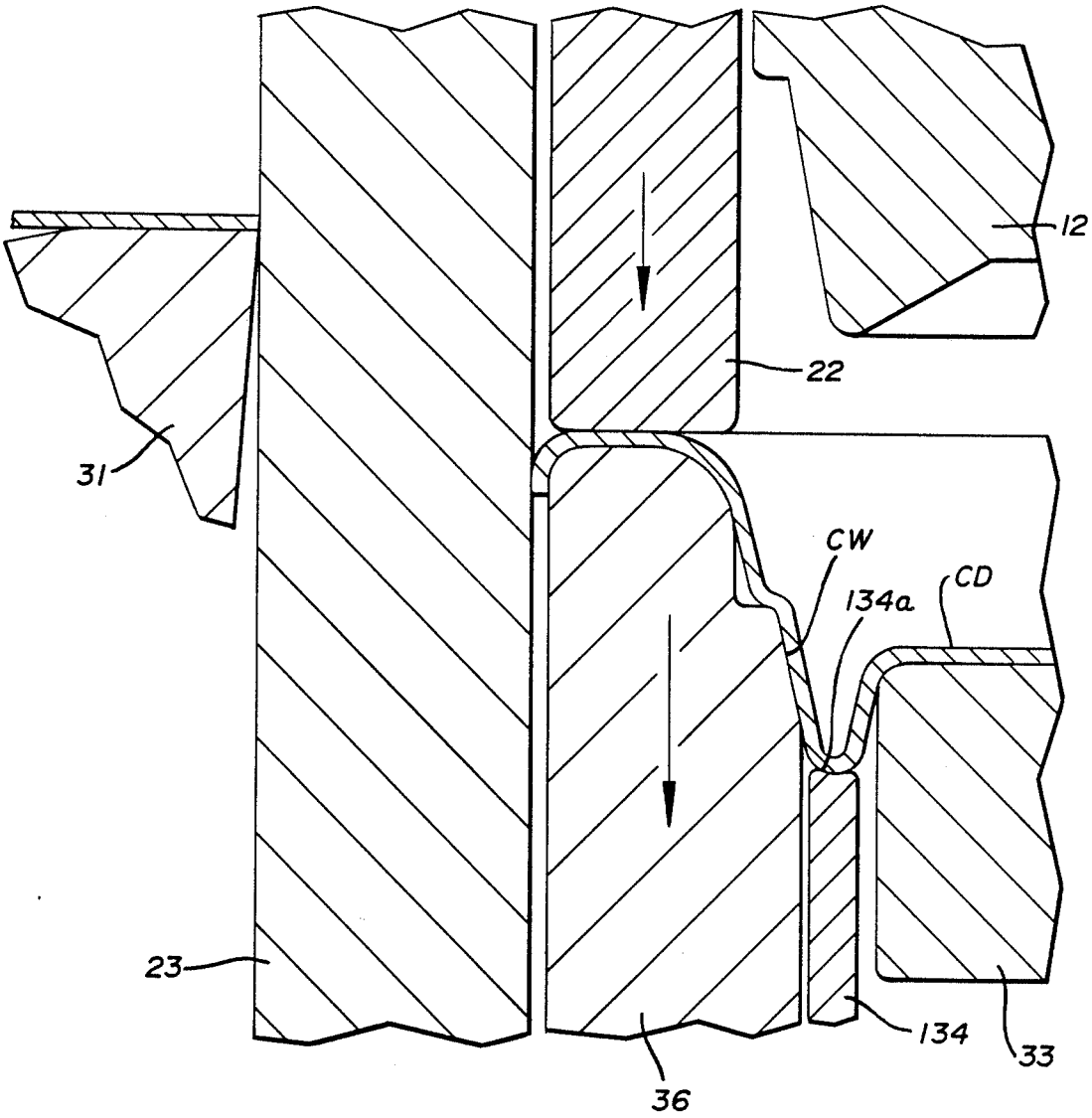
FIG. 8 is an enlarged, partial sectional view showing a modified knockout sleeve together with the relevant components of the tooling in a position similar to FIG. 6.

Referring to FIG. 8 of the drawings, it will be seen that a modified knockout sleeve is disclosed which permits operation of the apparatus, essentially as just described, while enhancing the concentricity of the chuckwall CW and radiused area R.

Since only the knockout sleeve differs in the FIG. 8 modification, the tooling components have been given the same numbers as in FIGS. 1 through 6, except that the knockout sleeve is identified by the numeral 134.

It will be noted that sleeve 134 has a concave top surface 134*a* and that the sleeve is supported by fluid pressure through bore 34*a* (see FIG. 1).

As the upper pressure sleeve 22 continues its downward movement, overcoming the fluid pressure supporting die core ring 36 and punch 12 lifts off, as previously described, the material M will be forced into the space between die core ring 36 and die core 33 so as to shorten chuckwall CW and tighten radius R. However, the radiused area 134*a* of knockout sleeve 134 will engage and support radius R, thereby insuring that the radius and the chuckwall will be concentric about the midpoint of center bottom portion CD. As will be appreciated by those skilled in this art, this concentricity is important to insure that the subsequent double seaming of the end panel to the container is effective.

While this concentricity can often be achieved by the nose of the punch, that limits the tightness of the radius for reasons already explained. Thus, with the FIG. 8 modification, the apparatus achieves both the tighter radius and concentricity.

While a full and complete description of the invention has been set forth in accordance with the dictates of the patent statutes, it should be understood that modifications can be resorted to without departing from the spirit of or the scope of the appended claims.

What is claimed is:

1. A method of forming a container end piece from a sheet of material at one station in a double acting press having a fixed base and a movable platen, comprising the steps of:

(a) blanking a workpiece;

(b) holding said workpiece between a pressure sleeve carried by the movable platen and a fluidly supported die core ring carried by the base;

(c) forming said workpiece into an inverted up over said die core ring advancing a punch shell carried by the movable platen toward the base;

(d) advancing a punch with a radiused annular nose and carried by the movable platen radially inwardly of the punch shell to reverse said inverted cup and form an end piece having a chuckwall joined to a central bottom portion by an enlarged radiused portion with said central bottom portion supported on a die core fixed to the base with said chuckwall being formed between complemental surfaces of said punch and said die core ring;

(e) shortening said chuckwall and reducing the radius of said the fluid pressure beneath said die core ring further while holding the workpiece against said die core ring and supporting said central bottom portion on said fixed die core.

2. Apparatus for forming a container end piece from a sheet of material at a single station in a double acting press having a fixed base and a movable platen, comprising:

(a) a die core ring fluidly supported on the fixed base and having a tape re d inner surface area;

(b) a punch shell carried by the movable platen;

(c) said punch shell telescoping over said die core ring upon movement of the movable platen toward the fixed base to form an inverted cup over said die core ring;

(d) a punch core carried by the movable platen and telescoping within said die core ring upon movement toward the fixed base to invert the cup and form a flange area, a central bottom area and a chuckwall interconnecting them;

(e) said punch core having a radiused nose area and a tapered external surface whereby a radiused area of a given dimension is formed between said chuckwall and said central bottom portion and a chuckwall is formed between said tapered external surface of said punch core and said tapered inner surface area of said die core ring;

(f) a die core fixed to the fixed base and spaced radially inwardly from said die core ring and supporting said central bottom portion;

(g) means carried by the movable platen for exerting pressure on said flange area to force said die core ring downwardly and force said chuckwall and said radiused area into the space between said die core ring and said die core to shorten said chuckwall and reduce said radius.

3. The apparatus of claim 2 wherein said last mentioned means include a pressure sleeve carried by the movable platen in opposed relationship with said die core ring and movable toward the fixed base.

4. Apparatus for forming a container end piece from a workpiece at a single station in a double acting press having a fixed base and inner and outer slides movable toward and away from the base, comprising:

(a) a die core fixed to the base;

(b) a die core ring fluidly supported on the base in concentric, spaced relationship with said die core and having a tapered inner surface area;

(c) a lower pressure sleeve fluidly supported on the base in concentric relationship with said die core ring;

(d) a punch core carried by the inner slide in opposed relationship with said die core and having a radius imparting distal end and a tapered external surface adjacent said distal end;

(e) an upper pressure sleeve carried by the outer slide in opposed relationship with said die core ring;

(f) a punch shell carried by the outer slide in opposed relationship with said lower pressure sleeve;

(g) said upper pressure sleeve being movable toward the base to hold the workpiece against said die core ring;

(h) said punch shell being movable toward the base to form an inverted cup by bending the periphery of the workpiece about said die core ring;

(i) said punch core being movable toward the base to reverse said inverted cup and form a chuckwall between said tapered inner surface area of said die core ring and said tapered external surface of said punch core, a radiused area between the sidewall and bottom thereof;

(j) said upper pressure sleeve being further movable toward the base by movement of the outer slide to overcome the pressure supporting said die core ring and forcing metal from the sidewall into the area between said die core and said die core ring; and (k) whereby the sidewall is shortened and the radius of the radiused area is reduced.

5. A method of forming a container end piece in a press having a fixed base and a movable platen, comprising the steps of:

(a) blanking a workpiece;

(b) holding said workpiece between a pressure sleeve carried by the movable platen and a fluidly supported die core ring carried by the base;

(c) forming said workpiece into an inverted cup over said die core ring by advancing a punch shell carried by the movable platen toward the base;

(d) advancing a punch with a radiused annular nose and carried by the movable platen inwardly of the punch shell to reverse said inverted cup and form an end piece having a sidewall joined to a central bottom portion by an enlarged radiused portion with said central bottom portion supported on a die core fixed to the base; and (e) shortening said sidewall and reducing the radius of said enlarged radiused portion by advancing the pressure sleeve further while holding the workpiece against said die core ring, fluidly supporting and aligning supporting said central bottom portion on said die core.

6. Apparatus for forming a container end piece from a sheet of material in a press having a fixed base and a movable platen, comprising:

(a) a die core ring supported on the fixed base;

(b) a punch shell carried by the movable platen;

(c) said punch shell telescoping over said die core ring upon movement the movable platen toward the fixed base to form an inverted cup;

(d) a punch core carried by the movable platen and telescoping within s die core ring upon movement toward the fixed base to invert the cup and form a flange area, a central bottom area and a chuckwall interconnecting them;

(e) said punch core having a radiused nose area whereby a radiused area of a given dimension is formed between said chuckwall and said central bottom portion;

(f) a die core fixed to the fixed base and spaced radially inwardly from said die core ring;

(g) a knockout sleeve fluidly supported on said fixed base concentric w said die core and disposed between said die core and said die core ring and having a concave upper surface; and (h) means carried by the movable platen for exerting pressure on said flange area to force said chuckwall and said radiused area into the space between said die core ring and said die core and into engagement with said knockout sleeve to shorten said chuckwall and reduce said radius.

7. The apparatus of claim 6 wherein said last mentioned means include a pressure sleeve carried by the movable platen in opposed relationship with said die core ring and movable toward the fixed base.

8. Apparatus for forming a container end piece from a workpiece in a double acting press having a fixed base and inner and outer slides movable toward and away from the base, comprising:

(a) a die core fixed to the base;

(b) a die core ring fluidly supported on the base in concentric, spaced relationship with said die core;

(c) a lower pressure sleeve fluidly supported on the base in concentric relationship with said die core ring;

(d) a knockout sleeve having a concave upper surface and fluidly supported on said fixed base between said die core and said die core ring;

(e) a punch core carried by the inner slide in opposed relationship with said die core and having a radius imparting distal end;

(f) an upper pressure sleeve carried by the outer slide in opposed relationship with said die core ring;

(g) a punch shell carried by the outer slide in opposed relationship with said lower pressure sleeve;

(h) said upper pressure sleeve being movable toward the base to hold the workpiece against said die core ring;

(i) said punch shell being movable toward the base to form an inverted cup by bending the periphery of the workpiece about said die core ring;

(j) said punch core being movable toward the base to reverse said inverted cup and form a chuckwall and a radiused area between the periphery of the workpiece and bottom thereof;

(k) said upper pressure sleeve being further movable toward the base by movement of the outer slide to overcome the pressure supporting said die core ring and forcing material from the sidewall into the area between said die core and into engagement with said knockout sleeve; and (l) whereby the sidewall is shortened and the radius of the radiused area is reduced.

* * * * *

UNITED STATES PATENT AND TRADEMARK OFFICE

CERTIFICATE OF CORRECTION

PATENT NO. : 4,808,052

DATED : February 28, 1989

INVENTOR(S) : Bulso, Jr., et al.

It is certified that error appears in the above-identified patent and that said Letters Patent is hereby corrected as shown below:

In Column 4, Line 48, delete "3" and substitute therefor --33--.

In Column 5, Line 43, delete "up" and substitute therefor --cup--.

In Column 5, Line 44, between the words "ring" and "advancing", insert the word --by--.

In Column 5, Line 56, between the words "of said" and "the fluid", insert the following --enlarged radiused portion by advancing the pressure sleeve and overcoming--.

In Column 5, Line 65, delete "tape re d" and substitute therefor --tapered--.

In Column 7, Line 22, between the words "aligning" and "supporting", insert the following --said radiused portion and--.

In Column 7, Line 30, between the words "movement" and "the movable", insert the word --of--.

UNITED STATES PATENT AND TRADEMARK OFFICE

CERTIFICATE OF CORRECTION

PATENT NO. : 4,808,052

DATED : February 28, 1989

INVENTOR(S) : Bulso, Jr., et al.

It is certified that error appears in the above-identified patent and that said Letters Patent is hereby corrected as shown below:

In Column 7, Line 33, delete "s" and substitute therefor --said--.

In Column 7, Line 44, delete "w" and substitute therefor --with--.

Signed and Sealed this

Twenty-fifth Day of July, 1989

*Attest:*

DONALD J. QUIGG

*Attesting Officer*

*Commissioner of Patents and Trademarks*